US006840165B1

(12) United States Patent
Leppäkoski et al.

(10) Patent No.: US 6,840,165 B1
(45) Date of Patent: Jan. 11, 2005

(54) METHOD AND ASSEMBLY FOR OPENING CALENDER NIPS

(75) Inventors: Helena Leppäkoski, Lempäälä (FI); Pekka Koivukunnas, Järvenpää (FI); Kari Hasanen, Kerava (FI)

(73) Assignee: Metso Paper, Inc., Helsinki (FI)

( * ) Notice: Subject to any disclaimer, the term of this patent is extended or adjusted under 35 U.S.C. 154(b) by 220 days.

(21) Appl. No.: 10/088,457

(22) PCT Filed: Sep. 22, 2000

(86) PCT No.: PCT/FI00/00817

§ 371 (c)(1),
(2), (4) Date: Mar. 15, 2002

(87) PCT Pub. No.: WO01/21888

PCT Pub. Date: Mar. 29, 2001

(30) Foreign Application Priority Data

Sep. 24, 1999 (FI) ..... 19992058

(51) Int. Cl.[7] ..... B30B 15/28; D21G 1/00

(52) U.S. Cl. ..... 100/35; 100/39; 100/47; 100/95; 100/168; 700/127; 702/138; 162/205

(58) Field of Search ..... 100/35, 38, 39, 100/47, 153, 161, 163 R, 168, 169, 170, 171, 94, 97, 95, 96; 162/205, 206, 358.3, 358.5, 359.1, 361; 700/127; 702/138–139

(56) References Cited

U.S. PATENT DOCUMENTS 4,283,821 A 8/1981 Paakkunatinen ..... 29/129
4,485,734 A * 12/1984 Klemmer et al. ..... 100/168
4,799,997 A 1/1989 Thompson ..... 162/255
5,052,233 A 10/1991 Rantala ..... 73/862
6,293,175 B1 * 9/2001 Enwald et al. ..... 83/13

FOREIGN PATENT DOCUMENTS

DE 299 02 451 U1 7/1999 ..... D21G/1/00
EP 0 321 561 6/1989 ..... D21G/1/02
GB 1 011 114 11/1965

* cited by examiner

*Primary Examiner*—Allen Ostrager
*Assistant Examiner*—Jimmy Nguyen
(74) *Attorney, Agent, or Firm*—Cohen, Pontani, Lieberman & Pavane

(57) ABSTRACT

The present invention relates to a method and assembly for opening the nips (9,10) of a calendar comprising at least two elements (1, 2; 3, 4) brought to a nip contact with each other, especially for performing the nip opening at a break or damage occurring in the web (5) being calendered. The tension of the web (5) being calendered is measured at multiple points over the cross-machine width of the web (5) and the calender nips (9,10) are opened when the measured web tension at a preset number of points over the cross-machine width of the web (5) has fallen to a limit value that by a decision-making algorithm monitoring the tension profile of the web (5) is interpreted to indicate a web break situation or other damage on the web (5) requiring opening the nips (9,10).

14 Claims, 1 Drawing Sheet

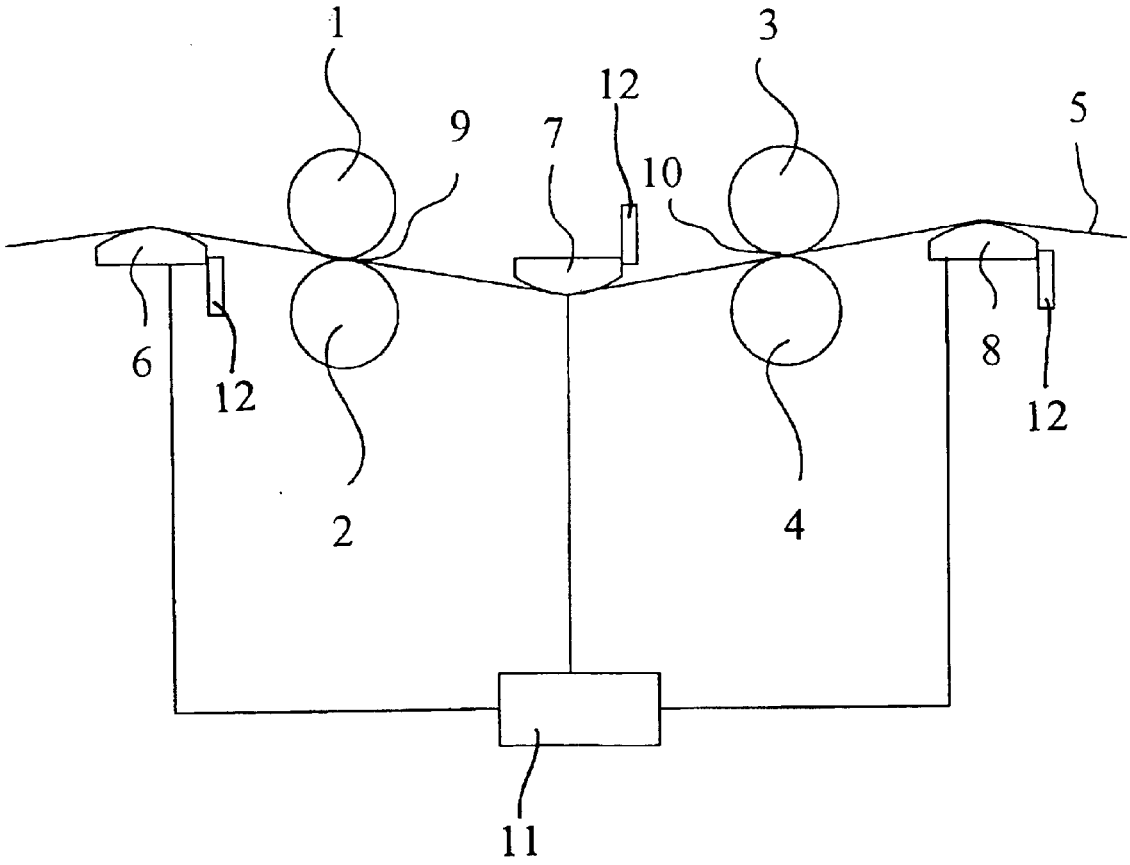
1
3
12
9
7
10
5
6
12
8
12
2
4
11

METHOD AND ASSEMBLY FOR OPENING CALENDER NIPS

PRIORITY CLAIM

This is a national stage of PCT application No. PCT/FI00/00817, filed on Sep. 22, 2000. Priority is claimed on that application, and on patent application No. 19992058 filed in Finland on Sep. 24, 1999.

FIELD OF THE INVENTION

The present invention relates to a method and an assembly for opening calender nips, especially upon the occurrence of break in a web being calendered. The invention also relates to a method for detecting a break in a moving web.

BACKGROUND OF THE INVENTION

Conventionally, the surface of a moving web of paper or board is smoothed and made glossy in a multiroll calender comprising a plurality of rolls stacked in a calender frame so as to form a nip contact with each other. A multiroll calender comprises a top roll and a bottom roll with at least one intermediate roll located therebetween. The rolls of the stack are compressed against each other by the top and bottom rolls that act as the loading rolls to provide a sufficiently high linear nip force. In calendering, the web passes through the calender nips formed by the superimposed rolls. A soft-roll calender typically has two or four nips placed in a succession in separate calender frame sections thus allowing the web being calendered to pass straight between two successive nips. In a conventional two-nip soft-roll calender, the web is calendered once on either side.

Some of the calender rolls are heatable, hard-surfaced thermorolls, while some others are rolls surfaced with a soft coating. For instance, one of the rolls in a roll pair of a soft-roll calender is generally a metal-surfaced thermoroll and the other is soft-coated roll. The thermoroll is typically heated with oil or some other heat-transfer medium such as water or steam. Using oil as the heating medium, a roll temperature of almost 300° C. can be reached. However, the temperature of the thermoroll is typically about 200° C. Circulation of the heat-transfer medium in the roll can be accomplished in different ways. The most frequently employed technique is to feed the heat-transfer medium into and out from the roll via a single end only, whereby the medium first is passed along one duct to the roll end and then the return flow takes place along a parallel duct. The return flow exits the roll to a reheating circuit via a bore made to the roll end flange and the roll shaft.

In the material selection for soft-coated rolls, the possible temperature elevation caused by an adjacent thermoroll must be taken into account. The surface coverings of soft-coated rolls are selected from the group of materials compatible with the rugged conditions imposed by the nip contact, such as a generally available polymer of the thermosetting or thermoplastic type, for instance. Rolls coated with a thermoplastic polymer are described in, e.g., publication GB 1,011,114, while rolls coated with a thermosetting polymer are described in, e.g., publication EP 321,561. In the prior art it was conventional to make the covering of soft-coated rolls from natural-fiber-based materials such as those described in, e.g., publication U.S. Pat. No. 4,283,821.

As the web being calendered may in some cases break during calendering, either prior to or after the calendering step, it is necessary to have an ability to open the calender nips as rapidly as possible at the occurrence of a web break.

Opening the nips is particularly important in calenders having soft-coated rolls. Namely, the thermorolls of closed nips begin after the web break to heat the adjacent soft-coated rolls because there is no more paper web running through the nip so as to remove the heat emitted by the thermorolls. Consequently, the soft-coated rolls may overheat resulting in a roll becoming damaged. In modern calenders running at high web speeds, also the amount of heat transferred to the thermorolls may be substantially large, which means that an extremely rapid opening of a thermoroll nip is mandatory, even as fast as a few tenths of a second if the web break occurs just upstream from a nip.

To prevent damage to soft-coated rolls, calenders are equipped with automatic web-breakage control that opens the calender nips immediately at a web break. Typically, the occurrence of web breaks is monitored by means of photocell curtains installed over the web in the cross-machine direction. As the detection of a web break must take place in a short time, it is not possible to apply a sufficient filtration to the output signal obtained from the photocells. Hence, a small defect, such as a hole in the web, may be interpreted as a web break even if the defective portion of the web in fact might pass the calender without problems. However, due to the high price of the soft-coated rolls, it is customary to set the control system to open the nips already at the occurrence of the smallest defects. As a consequence of such an erroneous or oversensitive response of the automatic web-breakage control system, the calender nips are opened, which is an ultimate cause to an actual web break.

SUMMARY OF THE INVENTION

It is an object of the present invention to overcome the problems of the above-described prior art and to provide an entirely novel method and assembly suited for opening the nips of a calender passing a web being calendered at the instant a web break or damage is detected. It is a further object of the invention to provide an entirely novel method for detecting a break in a moving web.

The goal of the invention is achieved by way of measuring the tension profile of the web being calendered at multiple points over the cross-directional width of the web, whereby a proper processing of the measurement signal makes it possible to categorize a detected defect as an actual web break necessitating the opening of the nips or as a damaged surface area or minor defect of the web that may be assumed to pass the calender without major problems. The web tension profile may be measured, e.g., by arranging the moving web to pass over an arcuate tension gauging bar. The tension gauging bar is provided with holes communicating with sensors mounted at the holes so that the local pressure of the air cushion formed between the moving web and the gauging bar can be measured. The pressure of the air cushion at a given point is proportional to the web tension at said point. The calender nips are opened when the web tension at a preset number of points over the cross-machine width of the web has fallen to a value at which the decision-making algorithm monitoring the overall tension profile of the web interprets the situation as a web break or an extensive defect on the web that requires the opening of the nips. The web tension may be measured, e.g., in front of the calender, after the calender or between two nips thereof.

The invention offers significant benefits.

By way of monitoring the cross-machine tension profile of the web being calendered, it is possible to discriminate web breaks and other major defects from such minor defects that can be expected to pass the calender without problems in a manner significantly more reliable than what can be attained through the use of photocells. By the same token, web breaks induced by an incorrect interpretation of web -monitoring signals are reduced, thus contributing to a higher availability of the calender and reduced amount of broke. In the embodiment according to the invention, it is possible to define optimally the area of maximum web damage, and the respective tension profile, that still permits the respective portion of the web to be passed through the calender without encountering major problems. Moreover, it is possible to detect the damaged portion of the web by virtue of the web tension profile measurement before the web is passed through the calender, thus giving a highly reliable technique of opening the nips before damage is caused to the soft-coated rolls. As the preset web tension monitoring values triggering the opening of the nips can be easily changed, the arrangement according to the invention is easily applicable to different paper grades. Furthermore, the apparatus used for web tension measurement has a relatively simple construction that can be easily adapted to operate in conjunction with an existing calender.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to the appended drawing representing diagrammatically a two-nip calender.

DETAILED DESCRIPTION OF THE PRESENTLY PREFERRED EMBODIMENTS

Referring to the drawing, the calender construction shown therein comprises two nips 9, 10 formed by members brought into a nip contact, such as rolls and/or the shoes of a shoe press. In the embodiment illustrated in the drawing, the nip 9 is formed by rolls 1, 2 and the nip 10 is formed by rolls 3, 4. Typically, one of the rolls 1–4 forming the nips 9, 10 is a hard-surfaced thermoroll heated by oil, steam or water, while the other roll of the nip is a soft-coated roll. In a conventional two-nip calender, the web 5 is passed almost straight through the nips 9, 10. As the pressure imposed thereon causes the web 5 to increase in width in the first nip 9, there are conventionally placed a number of guide and spread rolls between the nips 9, 10 so that the web 5 can be spread and tensioned. Generally, the rolls 1–4 of a soft-roll calender are arranged so that the web 5 passing the nips 9, 10 can be calendered on both sides, whereby the hard-surfaced and the soft-coated roll 1, 2 of the first nip 9 are placed in a reversed order in regard to that of the rolls 3, 4 of the second nip 10. In the drawing, the travel direction of the web 5 is denoted by an arrow.

In the travel direction of the web 5 being calendered, at a point preceding the first nip 9, there is placed a gauging device 6 that measures the cross-machine tension profile of the web 5. A similar gauging device 7, 8 is also placed at a point between the nip 9 and the next nip 10, as well as to a point downstream from the nip 10 in the travel direction of the web 5. Alternatively, the gauging device can be located at only one or two of the above-mentioned points, whereby the gauging device is most advantageously placed upstream from the nips 9, 10 in regard to the travel direction of the web 5.

The device 6, 7, 8 measuring the tension profile of the web being calendered may be, e.g., an arcuate sensor bar incorporating a plurality of holes aligned in a row essentially at right angles in regard to the web travel direction, each one of the holes having a separate pressure sensor communicating therewith. The web 5 being calendered passes over the sensor bar 6, 7, 8 supported by an air cushion that is formed when the boundary air layer entrained with the web 5 is compressed between the sensor bar 6, 7, 8 and the web 5. The cross-machine tension profile of the web 5 can be determined by way of measuring the local pressure between the running web 5 and the arcuate section of the sensor bar 6, 7, 8 by means of the pressure sensors communicating with the holes of the sensor bar 6, 7, 8. Obviously, at points where the web 5 is broken or the web 5 has a hole, there cannot be formed any air cushion or, if an air cushion exists, its pressure is lower than at an intact point of the web 5. The structure of one such embodiment of a gauging bar 6, 7, 8 is described, e.g., in more detail in patent publication U.S. Pat. No. 5,052,233.

The nips 9, 10 of the calender are opened when the web tension measured at a desired number of cross-machine points of the web 5 have fallen to a limit value at which a device 11 operating a decision-making algorithm which monitors the tension profile of the web 5 interprets the situation to be a web break or a so extensively damaged area of the web 5 that requires the opening of the nips 9, 10. Herein, a cross-machine point of the web 5 must be understood to refer to a measurement area monitored by a single sensor or an area of the cross-machine width of the web 5 defined by any other method. When a decision must be made to open the nips 9, 10, it is not necessary to detect an almost complete break of the web 5, but instead, it is generally sufficient to detect a larger defect than that represented by a minor hole in the web 5 or a ragged edge of the web 5.

The decision-making algorithm of the above-described method can be implemented by way of, e.g., giving the cross-machine tension of the web 5 a reference value to which the tension values sensed by the gauging devices 6, 7, 8 are compared. The widths of the areas on the web 5 at the points, where the measured value of the web tension fall below the preset reference value, are summed. Next, the summed width of the defective areas over the cross-machine width of the web 5 falling short of the preset reference value is compared to the overall width of the web 5, whereby any violation of an adjustably-defined preset limit value of damaged area triggers the opening of the nips 9, 10. In other words, the summed width of the areas detected in the web 5 falling short of the preset limit value are herein considered to represent the width of the damaged area in the web 5. For instance, if the web 5 being calendered breaks entirely, the measured tension of the web falls below the preset reference value at least essentially over the entire width of the web 5. Experimental data can be used in the determination of the reference value and the limit value representing the maximum summed width of the damaged areas to the overall width of the web 5 that may be assumed to pass the web 5 through the calender without problems. Generally, there must be determined different reference and limit values for each one of the paper grades to be produced. Obviously, it is necessary to provide possibilities of changing the settings of the reference and limit values when the properties of the paper web being calendered vary.

Another technique of setting up the decision-making algorithm is to compute, e.g., a weighted average of the measurement values obtained from the different points over the cross-machine width of the web and then to open the nips 9, 10 when this value falls below the preset reference value. Typically, the weighing factor in the averaging computation is set proportional to the width of the measurement point in question.

The decision-making algorithm may also be designed to implement the above-described functions in a more intelligent manner utilizing, e.g., a model based on statistical analysis that takes into account, e.g., the magnitude of the normal variations in the web tension and makes an inference on a web break when the tension measurement values taken on the web 5 fall significantly below those expected to be encountered within the random variations of normal tension measurement data.

The method according to the invention for detecting a break in the web 5 is otherwise similar to the above-described method for opening calender nips, except that herein an indication of a web break is triggered when in the web 5 the summed width of the areas at which the measured tension value of the web 5 falls below a preset reference value becomes at least essentially equal to the overall width of the web 5.

In addition to those described above, the invention may have alternative embodiments.

In spite of the fact that the above arrangement using a gauging sensor bar for determining the cross-machine tension profile of the web being calendered can be appreciated as the most preferred embodiment of the invention, also other kinds of equipment suited for the task can be used. One kind of such apparatuses is a tension measurement roll axially divided in segments having the air- cushion pressure gauging sensors adapted therein.

As it may be difficult to adapt the web tension measuring equipment into the space remaining between the calender nips in multiroll calenders comprising a plurality of nips formed by superposed rolls, the measurement of the cross-machine web tension profile must in practice be performed either upstream and/or downstream of the calender.

After the decision-making algorithm has detected a web break or a defective point on the web 5, the web 5 may be severed by means of an air-jet cutting device 12 that cuts the web with the help of a compressed-air jet. After the web has been cut with the help of the compressed-air jet, the web 5 can be guided away from the nips to prevent the web from becoming wound about the calender rolls. In practice, the cutting technique based on an air jet is much safer than a web-cutting technique implemented with cutting knives, for instance. The air-jet cutting apparatus 12 may be integrated, e.g., in the above-described web tension gauging bar 6, 7, 8.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for determining when to open a nip of a calender comprising at least two elements brought into nip contact with each other, the method comprising:

measuring tension of a web being calendered in the calender at multiple points over a cross-machine width of the web, the tension of the web being measured at at least one of upstream and downstream of the calender with respect to a travel direction of the web;

determining when to open the calender nip based upon the measured web tension, a determination to open the calender nip occurring when, at a preset number of points over the cross-machine width of the web, the measured web tension has fallen below a limit value that is interpreted to indicate damage to the web less than a complete break of the web; and transmitting an instruction to open the nip of the calender when it is determined, based upon the measured web tension, that the calender nip should be opened.

2. The method of claim 1, further comprising:

selecting reference web tension values for tension of the web measured at a plurality of portions of the web on the cross-machine width of the web;

comparing the measured web tension of the web at the plurality of particular portions of the web to the reference web tension values for the corresponding portions of the web to determine portions of the web where the measured web tension falls below the corresponding reference tension values;

summing the width of the portions of the web where the measured web tension falls below the corresponding reference tension values to obtain a summed damaged width portion of the web; and determining that the calender nip should be opened when the summed damaged width portion of the web exceeds a preset reference limit value.

3. The method of claim 1, wherein:

selecting reference web tension value for tension of the web;

computing a weighted average of the measured tension of the web obtained at the multiple points of the web over the cross-machine width of the web; and determining that the calender nip should be opened when the weighted average falls below the reference web tension value.

4. The method of claim 3, wherein a width of an area of the cross-machine width of the web where the web tension is measured is used as a weighing factor in computing the weighted average.

5. The method of claim 1, wherein the tension of the web is measured indirectly by measuring pressure of an air cushion formed between the moving web and a gauging bar, the gauging bar being located in close proximity to the web and having an at least partially arcuate shape in the travel direction of the web.

6. The method of claim 1, further comprising severing the web with the help of an air-jet cutting device when a determination has been made to open the nip of the calender.

7. An apparatus for determining when to open a nip of a calender comprising at least two elements capable of being brought into nip contact with each other, the apparatus comprising:

a gauging device positioned and operable for measuring tension of a web being calendered in the calender at multiple points over a cross-machine width of the web, the gauging device being positioned at at least one of upstream and downstream of the calender with respect to a travel direction of the web; and a device operating a decision-making algorithm using as an input the web tension measured by the gauging device, the decision making algorithm determining to transmit an instruction to open the nip of the calender when the web tension measured at a preset number of points over the cross-machine width of the web has fallen below a limit value interpreted to indicate damage to the web less than a complete break of the web.

8. The apparatus of claim 7, wherein the gauging device is positioned upstream of the calender.

9. The apparatus of claim 7, wherein the gauging device is positioned downstream of the calender.

10. The apparatus of claim 7, wherein the gauging device is a gauging bar shaped to have an at least partially arcuate surface in the travel direction of the web and has pressure sensors at holes formed thereon.

11. The apparatus of claim 7, further comprising an air-jet cutting device positioned and operable to sever the web when the device operating a decision-making algorithm has transmitted the instruction to open the nip of the calender.

12. The apparatus of claim 11, wherein the air-jet cutting device is positioned upstream of the calender.

13. The apparatus of claim 11, wherein said air-jet cutting device is integrated with the gauging device.

14. A method for detecting damage occurring in a web being calendered comprising:

measuring tension of a web being calendered in a calender at multiple points over a cross-machine width of the web, the tension of the web being measured at at least one of upstream and downstream of the calender with respect to a travel direction of the web;

determining that damage to the web is present when the measured web tension at a preset number of points over the cross-machine width of the web has fallen below a limit value that is interpreted to indicate damage to the web less than a complete break of the web requiring opening of a nip of the calender.

* * * * *